United States Patent [19]

Hickman

[11] Patent Number: 4,807,870

[45] Date of Patent: Feb. 28, 1989

[54] WALKING TRAINER

[76] Inventor: Allen G. Hickman, 309 Lynnhaven, Wash, Ill. 61571

[21] Appl. No.: 18,514

[22] Filed: Feb. 25, 1987

[51] Int. Cl.[4] ..... A61H 3/00

[52] U.S. Cl. ..... 272/70.3; 272/70.4; 272/144; 297/5

[58] Field of Search ..... 272/70.3, 70.4, 144; 135/65, 67; 128/25 R, 133, 134; 280/242 WC, 289 WC, 200; 297/5, 6, 284, 4

[56] References Cited

U.S. PATENT DOCUMENTS

| | | | |
|---|---|---|---|
| 951,560 | 3/1910 | Eaton | 272/144 X |
| 2,459,066 | 1/1949 | Duke | 297/5 |
| 2,591,912 | 4/1952 | Block | 272/70.3 |
| 4,188,966 | 2/1980 | Palmer et al. | 272/70.3 X |
| 4,307,715 | 12/1981 | Fante | 272/70.3 X |
| 4,617,919 | 10/1986 | Suhre | 128/134 X |
| 4,621,804 | 11/1986 | Mueller | 272/70.3 |
| 4,732,423 | 3/1988 | Condon | 297/284 |

FOREIGN PATENT DOCUMENTS

| | | | |
|---|---|---|---|
| 1257091 | 2/1961 | France | 272/134 |

*Primary Examiner*—Richard J. Apley
*Assistant Examiner*—Franklin L. Gubernick
*Attorney, Agent, or Firm*—Leon Gilden

[57] ABSTRACT

A walking trainer for use by individuals who either through disease or injury require the use of a controlled restraint device to enable them to exercise their limbs. The device comprises aligned vertical and horizontal torso restraints positioned on vertical and horizontal supports to allow mobility of the limbs while restraining the head and torso in a predetermined position. Body contacting members of the device are padded where the padding is further provided with removal fasteners to allow for cleaning.

1 Claim, 1 Drawing Sheet

WALKING TRAINER

BACKGROUND OF THE INVENTION

1. Field of the Invention

The present invention relates to a walking trainer, and more particularly pertains to a new improved walking trainer for use by individuals who, through either disease and or injury, require such an implement to assist in their recovery.

2. Description of the Prior Art

Trainers for people requiring the need for assistance in the restoration of their walking abilities is known in the prior art. Such devices in the past have addressed the problem but there has always been the need for a simple, secure and stable device that will help such individuals to regain the use of their lower limbs. An example of a prior art walking trainer is to be found in U.S. Pat. No. 4,188,966, which issued to B. Palmer on Feb. 19, 1980. The trainer disclosed in this patent illustrates an over center device which through a rather complex arrangement of levers and links supports an individual in the exercise of lower limbs to help regain mobility thereof. While an effective device, this particular trainer lacks the simplicity of design and ease of manufacture and above all, the stability that the present invention entails. Further, the comfort and lateral support, plus the ability required for an individual in a situation necessitating his recuperative abilities to be channeled to the use of his lower limbs, is incompletely addressed by the Palmer device.

More particularly, most conventional prior art devices to assist the user in the recovery of their walking abilities do not address the problem of providing both comfort to the user and maximum stability, thus allowing a user to funnel his energy in obtaining the use of their lower limbs. U.S. Pat. No. 1,307,058, which issued to J. T. McGrath on June 17, 1919, sets forth a combination of comfort and stability allowing for maximum use of the device by the intended, but neglects the securement of the torso to enable the user to channel his energies to proper recovery. Similarly, in U.S. Pat. No. 1,448,783, which issued to M. A. Blewitt et al on Mar. 20, 1923, comfort and stability, while briefly addressed, are not adequate as can be noted from the disclosure therein since much of the energy of the user must be directed towards maintaining his torso in the proper position. Furthermore, the open perimeter of the device may inadequately provide for the safety and support of the user.

Further examples of prior art walkers are in U.S. Pat. No. 4,411,283, which issued to Frank J. Lucaselli on Oct. 25, 1983; U.S. Pat. No. 2,792,052, which issued to H. Johannesen on May 14, 1957; and U.S. Pat. No. 2,657,735, which issued to J A. Hughes on Nov. 3, 1953. Where the problem of comfort is addressed, the associate problem of stability is lacking.

Examples of mere transporting devices may be found in the patents to C. R. Flandrick, i.e., U.S. Pat. No. 2,903,238 and to William J. Reyer, i.e., U.S. Pat. No. 4,003,479. These patents depart substantially from the spirit and scope of the present invention and are simple transporting devices with limited capability for individuals to attempt a recovery of their lower limbs.

As can be seen from the preceding description of the prior art, there is a needed area of improvement in the design and use of walking trainers that are stable, comfortable, effective and further easily maintained to help individuals recover the use of their lower limbs. The present invention substantially fulfills this need.

SUMMARY OF THE INVENTION

In view of the foregoing disadvantages inherent in the known types of walking trainers now present in the prior art, the present invention provides an improved walking trainer construction wherein the same can provide substantially more head and torso support while also providing more comfort and stability to the user thereof. As such, the general purpose of the present invention, which will be subsequently described in greater detail, is to provide a new and improved walking trainer which has all the advantages of the prior art use of such trainers and none of the disadvantages.

To attain this, the present invention comprises a simplified tubular frame construction utilizing a quadrangular design to achieve the great stability inherent in such a construction. The key features of such a trainer are the significant use of padding wherever the patient's body and head require support. The user is not only supported laterally by the generous use of side supports, but support in the crotch or seat area of the user enables a greater degree of comfort. The padded portions of the device are all easily removable for replacement, repair, or cleaning of damaged, stained or soiled parts. This of course adds to the useful life and comfort of the device and further assists the user in maintaining a hygienic device. Additionally, ball rollers are adjustable for height to accommodate different leg lengths, and the mobility of the device is enhanced by the use of such ball rollers as opposed to wheels that have an inherent resistance when negotiating turns. The aforenoted quadrangular tubular construction of the device provides the rigidity and stiffness required.

Head support is provided by a plurality of laterally positioned padded members that provide necessary lateral head support. These members are vertically and pivotally adjustable to accommodate a large number of various shaped heads and thereby provide comfort to each user. An optional chin support is also provided in the event that such additional support is needed.

The torso supports are also pivotal and vertically adjustable, as well as horizontally positionable to accommodate again a large number of individuals of varying physical shapes. An optional use of lap seat belts to secure the user as is required are available. These seat belts are easily removable and upon the physical improvement of the user, they may be eliminated. An elongated crotch support member is vertically adjustable for comfort. In addition, this support spans the full length of the apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walking trainer which has all the advantages of the prior art walking trainers and none of the disadvantages.

It is another object of the present invention to provide a new and improved walking trainer which may be easily and efficiently manufactured and marketed.

It is a further object of the present invention to provide a new and improved walking trainer which is of a durable and reliable construction.

An even further object of the present invention is to provide a new and improved walking trainer which is susceptible of a low cost of manufacture with regard to both materials and labor, and which accordingly is then susceptible of low prices of sale to the consuming public, thereby making such walking trainers economically available to the buying public.

Still yet another object of the present invention is to provide a new and improved walking trainer which provides in the apparatuses and methods of the prior art some of the advantages thereof, while simultaneously overcoming some of the disadvantages normally associated therewith.

Still another object of the present invention is to provide a new and improved walking trainer designed for use by individuals which is substantially more comfortable than prior art walking trainers.

Yet another object of the present invention is to provide a new and improved walking trainer which is characterized by a lightweight and stable construction, thereby to facilitate the ease of mobility and transport thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
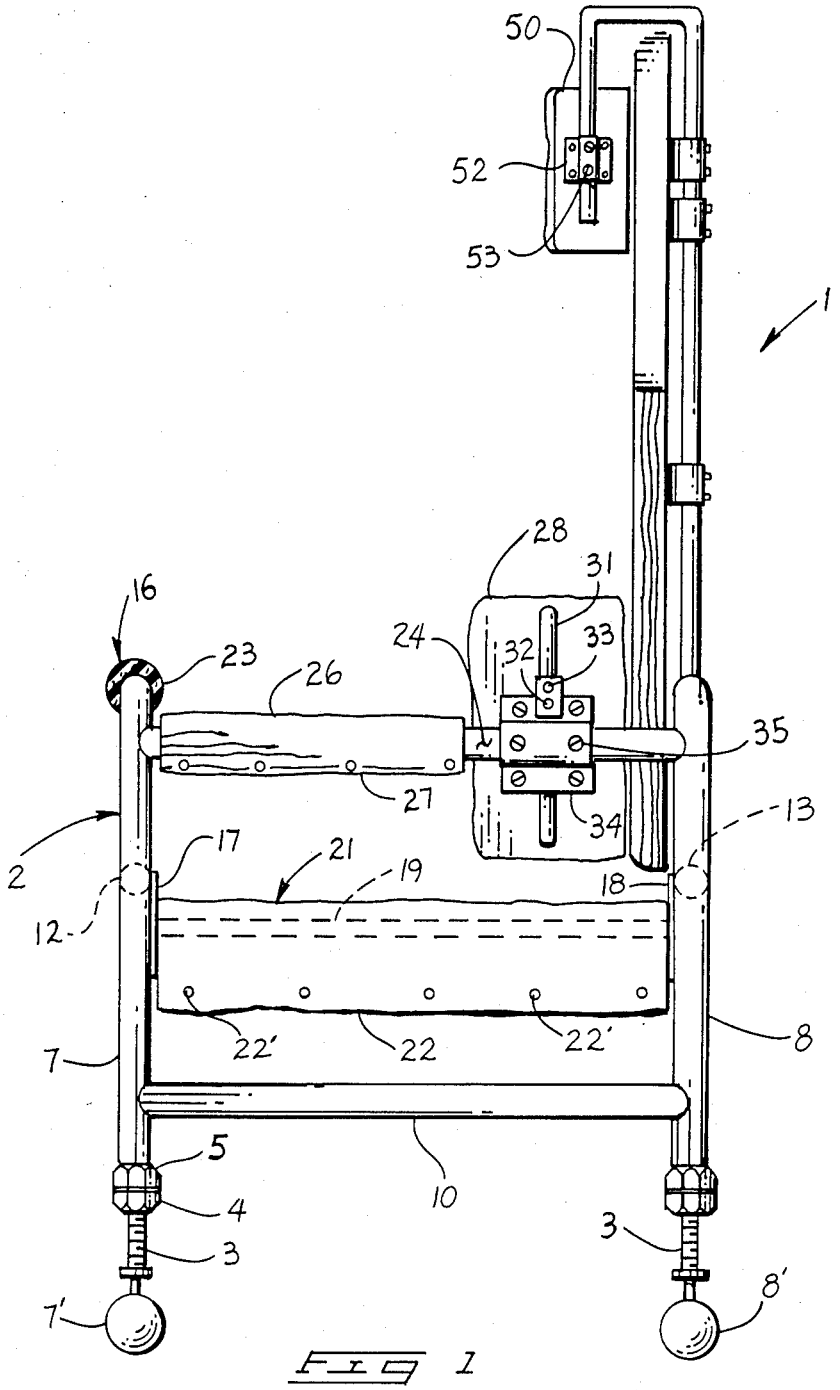
FIG. 1 is a side elevation view of the improved walking trainer which shows the apparatus ready for use.
Figure 2:
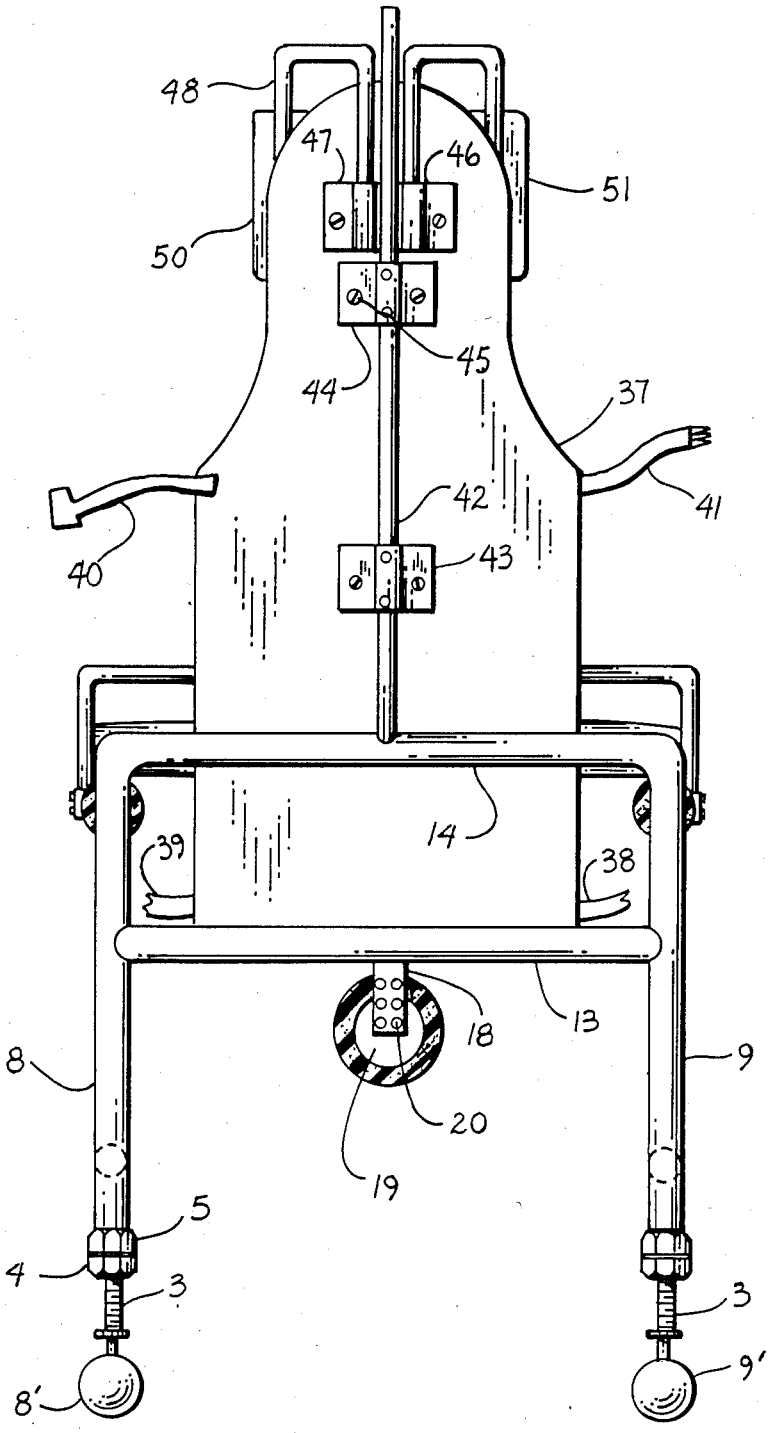
FIG. 2 is a rear elevation view of the improved walking trainer showing details of some of the adjustability features of the head and crotch supports.
Figure 3:
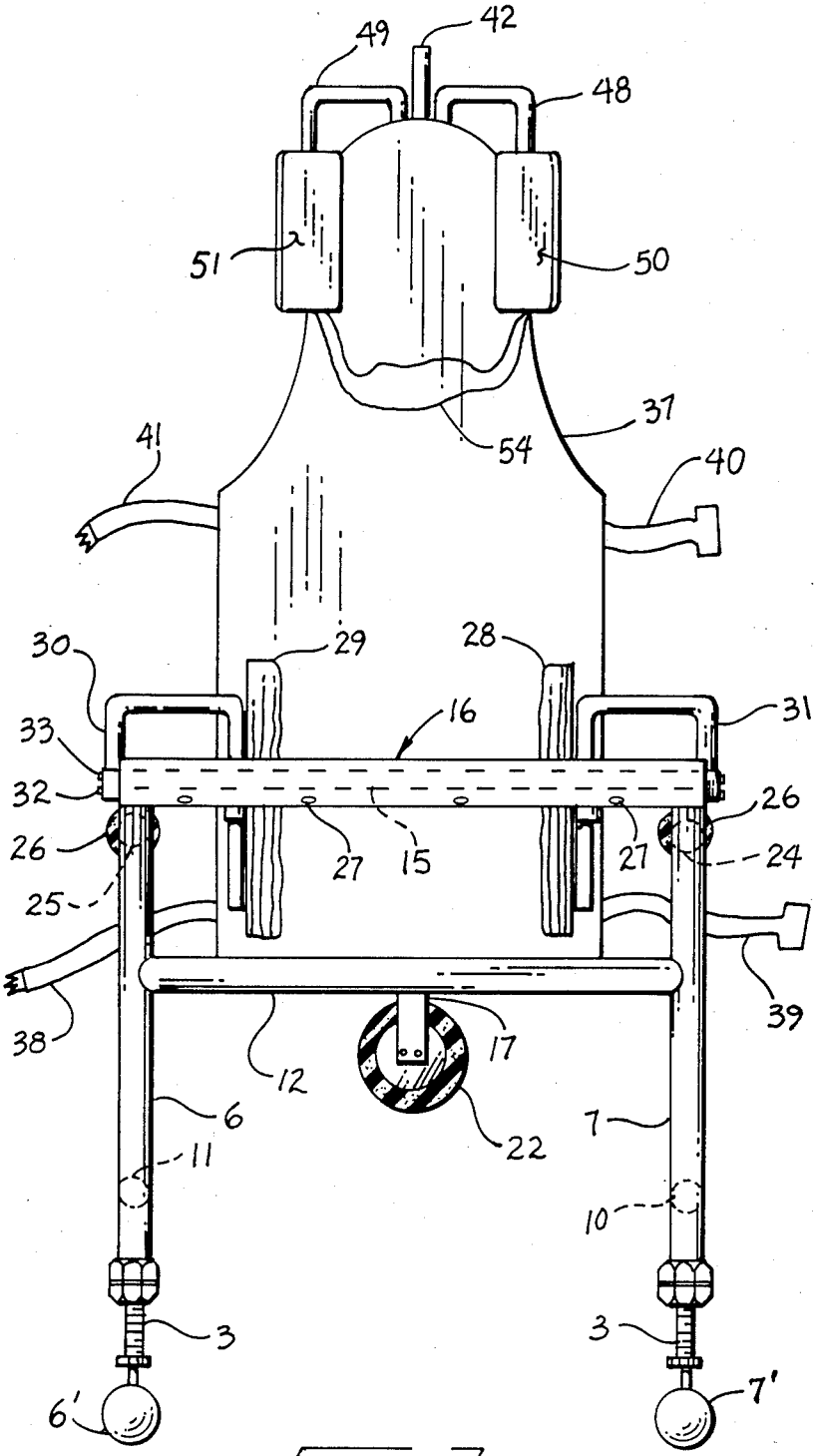
FIG. 3 is a front elevation view of the apparatus.

With reference now to the drawings, and in particular to FIGS. 1–3 thereof, a new and improved walking trainer embodying the principles and concepts of the present invention and generally designated by reference numeral 1 will be described.

Support carriage 2 of the walking trainer is composed of vertical support legs and horizontal attaching members to provide for a lightweight rigid construction. Four vertical support legs 6, 7, 8 and 9 have secured thereto respective ball rollers 6', 7', 8', and 9' for maximum mobility. The ball rollers are replaceable and may come in different sizes to accommodate different surfaces to be traversed, e.g. carpeting requires a larger ball roller than a smooth surface. The rollers are secured to threaded elements 3 threadedly engaging the vertical support legs. Interacting locking members 4 and 5 of conventional construction may be used to lock the ball rollers in whatever height desired according to the comfort and physical size of the user.

Horizontal braces 10, 11, 12, 13, 14 and 15, as well as pad 16, span the distances between the vertical supports, complete the support carriage and provide a compact unitized construction. The various components of the carriage and their interaction will now be described in further detail.

The horizontal braces 12 and 13 have secured thereto vertical plates 17 and 18 adjustably securing therebetween by fastening means 20 a crotch support member 21 whereby the height of the crotch support 21 may be positioned to accommodate various sizes of users. The crotch support is formed of tubular element 19 and formed therearound is a padded element 22. This padded element 22 may be made of any suitable material such a polyurethane etc. as is well known in the art, and in variable thicknesses to accommodate varying distances between user's legs. Additionally, this element, as are all the padded elements of the instant invention, is secured around its support or tubular element 19 by snap fasteners 22'. An immediate advantage that can be noted by these removable resilient coverings is that removal, repair and replacement of such coverings maintains a sanitized and comfortable environment for the user. Forward post 16 is similarly formed of a central post 15 surrounded by a padded element 23 and accordingly secured by snap fasteners 27. Snap fasteners may be replaced by other comparable means such as Velcro for example.

Side support elements 24 and 25 form respective left and right uppermost horizontal support elements of the carriage sides and are also padded in a like manner with resilient means 26 and secured with snap fasteners 27. These side support elements form not only the padded side rests necessary for the comfortable use of the device but also support the side torso means 28 and 29. The right and left torso support means 29 and 28 respectively are secured to the main carriage by U-shaped rods 30 and 31. The U-shaped rods are supported in turn by horizontal side support elements 24 and 25, on through attachment plates means 34 as exemplified in FIG. 1. These attachment plates are pivotal, and horizontally movable about horizontal supports 24 by the use of frictional securing means 35.

The side torso support means 28 and 29 are horizontally adjustable forward and rearward by loosening attachment plate means 34 and sliding the torso supports along the horizontal supports 24 and 25. The side torso support means are further adjustable inward and outward by loosening the securing means 33 in the housing 36 and rotating the U-shaped torso support attachment rods 30 and 31 inward or outward.

It is also noted that vertical height adjustments of torso supports 28 and 29 are available and may be positioned vertically by the securing means 33 coacting with housing 36 to support rod 31 slidably therethrough.

The rear body member 37 is attached to the carriage 2. The vertical head support post 42 has secured therearound brackets 43 and 44 attached securedly to the body member 37. Conventional threaded securing means 45 attach brackets 43, 44 to the body member to furthermore allow vertical head support post 42 to be positioned vertically therealong; loosening securing means 32 allows the member head support 42 to be adjusted to a desired vertical position and thereafter retightening the threaded means secures the vertical post 42 in a desired position.

Attached to the upper portion of the body member 37 are brackets 46 and 47 securing U-shaped rods 48 and 49 that support head support means 50 and 51. The respective left and right head support means 50 and 51 are secured to the secondary U-shaped rods by brackets 52. Vertical positioning is thereby allowed of head support means 50 and 51 via fasteners 53 The fasteners secure the head support means along the sections of the secondary U-shaped rods enabling positioning to accommodate again a large number of users.

An optional chin strap means 54 may be s to the head support by snap fasteners or any other suitable means if additional chin support is required.

It should be noted that optional upper and lower belt means as best illustrated in FIG. 2 depicted by numerals 40, 41, 38 and 39 securedly position the torso of the user in a comfortable and secure manner against the rear body member 37. The use of these belts is dependent greatly upon the needs of the user.

The manner of usage of the apparatus should be apparent from the foregoing description; however, a summary will be presented. The user is positioned within the carriage 2 and upon straddling the crotch support member 21, necessary belts 40, 41, 38 and 39 may be secured about the user as necessary along with chin strap 54. The torso members 28 and 29 are positioned vertically via adjusting screws 33, etc., as necessary, and are pivotally positioned using the adjusting screws 35 as is required to accommodate the physical configuration of the user. Head support members 50 and 51 are accordingly positioned vertically and angularly using screw members 53, along U-shaped support posts 48 and 49. The crotch support 21 may be vertically positioned using adjustment means 20 to position the legs of the user so that they are comfortably manueverable over the surface to be traversed. It may be seen that as the user gains strength, the support means for the head and torso as well as the seat belts may be relaxed thereby allowing the user more horizontal freedom within the confines of the walking trainer. While always confined within the walking trainer, the user may undergo progress not possible with other trainers of this variety as mobility within the confines of the carriage may be controlled.

The walking trainer is subject to ease of manufacture using reasonable tooling and materials and capable of producing very efficient stable and comfortable device to assist those in need of rehabilitation access to such a device.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A walking trainer for use on a variety of surfaces by users with varying degrees of walking disabilities comprising, a lower carriage means including parallel upper and lower rear horizontal frame members orthogonally secured at their ends to parallel rear vertical legs, and parallel pairs of upper and lower side horizontal frame members orthogonally secured to said rear vertical legs at rearward ends and orthogonally secured to parallel forward vertical legs, and parallel forward upper and lower horizontal frame members orthogonally secured between said forward vertical legs;

said upper forward horizontal frame member surroundingly encompassed by a removable padded member;

said rear and forward vertical legs including spherical rollers secured and axially aligned with said vertical legs are lowermost portions thereof; and vertically adjustable padded crotch support means extending between said lower forward and rear horizontal frame members, and an elongate upwardly extending rear body member securable to a vertical post horizontally secured to said upper rear horizontal member, and a plurality of head supports secured to first "U" shape rods are forward ends wherein said "U" shaped rods are pivotally secured proximate said vertical post at their other ends, and torso supports secured to second "U" shaped rods at forward ends wherein said secured "U" shaped rods are pivotally secured to said upper horizontal side frame members at their other ends.

* * * * *